US007204894B1

(12) United States Patent
Chase

(10) Patent No.: US 7,204,894 B1
(45) Date of Patent: Apr. 17, 2007

(54) ANNEALING OF HOT ROLLED STEEL COILS WITH CLAM SHELL FURNACE

(75) Inventor: David L. Chase, Carmel, IN (US)

(73) Assignee: Nucor Corporation, Charlotte, NC (US)

( * ) Notice: Subject to any disclaimer, the term of this patent is extended or adjusted under 35 U.S.C. 154(b) by 0 days.

(21) Appl. No.: 11/549,286

(22) Filed: Oct. 13, 2006

Related U.S. Application Data

(63) Continuation of application No. 11/279,192, filed on Apr. 10, 2006, now abandoned.

(51) Int. Cl.
*C21D 9/52* (2006.01)
*C21D 1/06* (2006.01)

(52) U.S. Cl. ..... 148/601; 266/252; 266/263

(58) Field of Classification Search ..... 266/249, 266/252, 263, 262; 148/601, 579
See application file for complete search history.

(56) References Cited

U.S. PATENT DOCUMENTS

| | | | |
|---|---|---|---|
| 2,113,537 A | 4/1938 | Hiemenz | |
| 2,613,070 A | 10/1952 | Verwohlt | |
| 3,636,579 A | 1/1972 | Sakakura et al. | |
| 3,855,019 A | 12/1974 | Salsgiver et al. | |
| 4,147,506 A | 4/1979 | Southern et al. | |
| 4,463,585 A | 8/1984 | Laws et al. | |
| 4,504,957 A | 3/1985 | McClelland et al. | |
| 4,527,409 A | 7/1985 | Ouwerkerk | |
| 4,817,920 A | 4/1989 | Erfort, Jr. | |
| 5,788,483 A | 8/1998 | Drigani et al. | |
| 6,177,044 B1 * | 1/2001 | Maschler et al. | 266/256 |
| 6,346,214 B1 | 2/2002 | Knudsen et al. | |
| 6,358,337 B1 | 3/2002 | Esteban Sanz et al. | |

FOREIGN PATENT DOCUMENTS

| | | |
|---|---|---|
| EP | 0468716 A2 | 1/1992 |
| JP | 61 060829 A | 3/1986 |

OTHER PUBLICATIONS

European Patent Office Standard Search Report issued Aug. 25, 2006.

* cited by examiner

*Primary Examiner*—Scott Kastler
(74) *Attorney, Agent, or Firm*—Hahn Loeser & Parks, LLP; Arland T. Stein

(57) ABSTRACT

Disclosed is a high temperature annealing furnace for hot rolled steel coils. The furnace of the present invention pivotably rotates about a pivot member between an opened and closed position. Prior to the annealing step, the hot rolled steel coils are placed within the housing of the furnace. The hot rolled steel coils are supported on a retaining element secured to a base portion located within the housing of the furnace. The hot rolled steel coils may be positioned on the base portion such that the axial opening of each coil is generally horizontal with the base portion.

17 Claims, 3 Drawing Sheets

ANNEALING OF HOT ROLLED STEEL COILS WITH CLAM SHELL FURNACE

This application is a continuation of U.S. patent application Ser. No. 11/279,192 filed Apr. 10, 2006, now abandoned, which is hereby incorporated by reference.

BACKGROUND

The present invention relates to the field of high temperature annealing of steel coils.

In the manufacture of flat-rolled steel sheet and strip products, it may often be important to intermittently anneal the material for further cold-rolling operations. It may also be necessary to anneal the material at the finish gauge to render it suitable for fabrication (e.g., stamping and cold forming). Annealing is important because cold reduction elongates the grains of the steel microstructure, distorts the crystal lattice, and induces internal stresses. The steel that results from the cold reduction process is typically very hard and has reduced ductility. The annealing process recrystallizes the cold-worked steel, and if the steel is held at the proper annealing temperature for a sufficient time, the microstructure of the annealed steel will return to substantially undistorted lattices and the steel will be more ductile. Cold-rolled steel and heat-resisting steel sheets can be produced by hot rolling, hot annealing and pickling, cold rolling-finish annealing and pickling (cold-rolled annealing and pickling), and subsequent skin-pass rolling. The finish annealing and pickling procedure generally comprises a continuous annealing, pickling or continuous bright annealing.

Annealing techniques may be divided into two general categories: (a) batch operations, such as conventional box annealing; and (b) continuous operations. In the steelmaking, the softening of flat rolled sheet and strip products is typically accomplished through the use of continuous annealing.

The continuous annealing process involves unwinding the coil from a payoff reel, continuously feeding the coil through an annealing furnace, and then rewinding the coil on a take-up reel. The annealing furnace is typically electric or gas fired. The steel strip, while traveling through the furnace, is typically heated to a temperature in the range of about 1800° F. to about 2200° F. in the case of austenitic alloys, and to a temperature in the range of about 1400° F. to about 1800° F. for ferritic alloys. The annealing temperatures vary depending upon the particular alloy being annealed and desired microstructure, as well as the end-use of the steel alloy.

A continuous annealing line is useful for mass production, but may not always appropriate for smaller production runs. Instead of finish annealing (cold-roll annealing) and pickling requiring huge facilities, the use of box annealing (also called "bell annealing" or "batch annealing") may be of economically advantageous in shorter production runs.

Batch coil annealing furnaces (sometimes called "box annealing furnaces" or "bell shaped" furnaces) have been long used and are well known in the industry. In such furnaces steel coils are stacked vertically, edge to edge, on a base, and a removable inner cover is placed over the stacked coils. An outer cover then is placed over the inner cover, and the covers are removably sealed to the base. The outer cover typically contains gas fired burners that heat the inner cover, and in turn radiation heats the stacked coils. Batch coil annealing processes in the steel mill industry typically take about 20 hours to several days to complete.

Prior art annealing furnaces are off-line annealing furnaces. Because of the size and time requirements of annealing, the furnaces are usually not in-line in a steelmaking line. Annealing treatment of metal product in such off-line processes normally involves long cycle times, resulting in low productivity levels, high heat treatment costs and less energy savings.

SUMMARY OF THE DISCLOSURE

The present invention relates to an annealing furnace for thermal treating of hot rolled steel coils. The furnace of the present invention anneals hot rolled steel coils and includes a housing that pivotably opens and closes about a pivot member. The present invention overcomes the disadvantages of the prior art and can obtain cycle times of less than 75 hours at a temperature range from about 1200° F. to about 1650° F. In one embodiment of the present invention, a method of converting hot rolled steel coil to a condition suitable for subsequent cold rolling includes annealing at least one hot rolled coil of steel in a furnace, wherein a portion of the furnace pivotably rotates about a pivot member between an opened and closed position, wherein the pivot member has a pivot axis generally lateral with its base portion, pickling the annealed steel coil, cold reducing the pickled steel coil and subjecting the cold reduced steel coil to a second annealing treatment.

A method is disclosed of annealing hot rolled steel coil comprising the steps of:

(a) assembling a furnace housing comprising a plurality of side walls, a base portion and a roof portion, where the housing pivotably rotates about a pivot member between an opened and closed position, wherein the pivot member has a lateral axis, (b) positioning hot rolled coils of steel in the furnace such that the axis of the coil is generally horizontal to the base portion, (c) pivoting housing about the hot rolled coils to close the furnace, (d) establishing a reducing atmosphere with the furnace, (e) annealing the hot rolled coil of steel in a furnace, and (f) pivoting housing about the hot rolled coils to open the furnace.

The hot rolled coils of steel may be placed on its circumferential surface within a retaining element with the axis of each steel coil.

The reducing atmosphere may comprise at least one inert gas and at least one polyolefin gas, and at least one inert gas may be nitrogen and at least one polyolefin gas may be propylene. The reducing atmosphere may comprise nitrogen gas in an amount greater than about 90%, hydrogen gas in a range between about 5% to about 7%, and propylene gas in an amount less than about 1%. The annealing of the hot rolled steel coil may provide a cycle time of less than 75 hours at temperature range from about 1200° F. to about 1650° F.

Also disclosed is a furnace for annealing hot rolled steel coil comprising:

(a) a furnace housing comprising a plurality of side walls, a base portion, a roof portion and a pivot member with an axis generally parallel with the base portion, where the housing pivotably rotates about a pivot member between an opened and a closed position;

(b) a retaining element within the furnace housing where the retaining element holds each coil such that the axis of each coil is generally horizontal to the base portion, (c) a sealing device capable of sealing the furnace housing when in closed position, (d) a system capable of establishing a reducing atmosphere within the furnace when sealed, and (e) a plurality of heating elements located within the furnace housing capable of heating hot rolled steel coil during the annealing process.

The retaining element may be configured such that each of the hot rolled steel coils is capable of resting on circumferential surface of the coils within the retaining element.

The furnace may be capable of providing annealing of the hot rolled steel coil in a cycle time of less than 75 hours at temperature range between about 1200° F. and about 1650° F. The system of the furnace may be capable of establishing a reducing atmosphere that comprises at least one inert gas, and at least one polyolefin gas and at least one inert gas may be nitrogen and at least one polyolefin gas may be propylene. The reducing atmosphere may comprise nitrogen gas in an amount greater than about 90%, hydrogen gas in a range between about 5% to about 7%, and propylene gas in an amount less than about 1%.

The above summary of the present invention is not intended to describe each embodiment or every implementation of the present invention. Advantages, together with a more complete understanding of the invention, will become apparent and appreciated by referring to the following detailed description and claims taken in conjunction with the accompanying drawings.

DETAILED DESCRIPTION OF THE DRAWINGS

Figure 1:
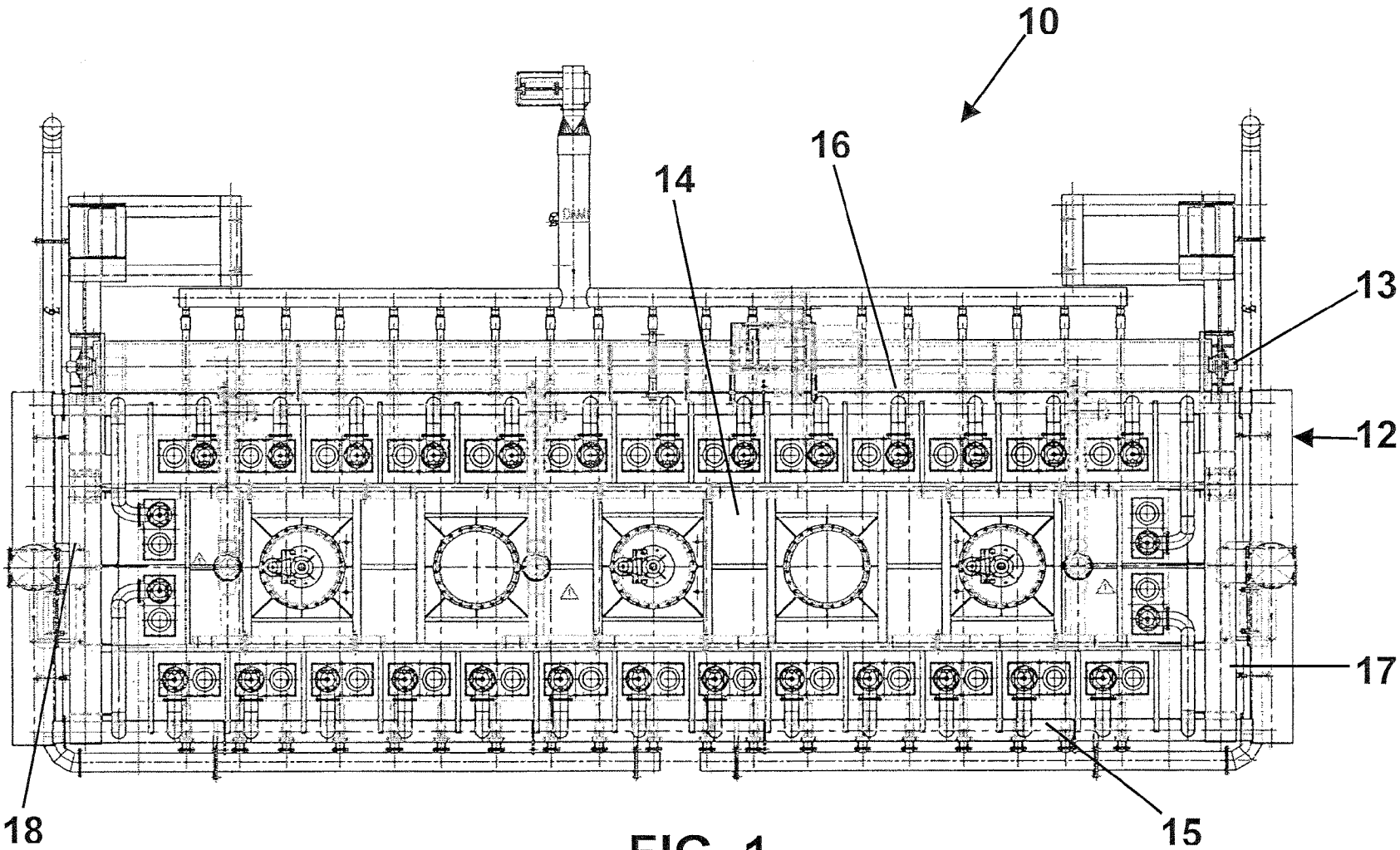
FIG. 1 is a plan view of the annealing furnace of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention is directed towards the hot roll annealing of steel coils. The annealing of hot roll steel coils is a novel processing route when compared with the standard cold roll annealing route, wherein the hot roll steel coils are typically pickled, annealed, sometimes pickled again, cold reduced and then annealed one last time. In comparison, the new processing route of the present disclosure, which may be a batch process, has hot rolled steel coils avoid the initial pickling step of the cold rolled annealing process and proceed directly to the annealing stage, wherein the annealed steel coils are then pickled, cold reduced and then annealed one last time if desired. This hot roll annealing process provides substantial energy savings, since the steel coils are annealed while they are still hot, and more consistent mechanical properties, as measured in the ksi yield strength, when compared to the standard cold roll annealing process.

Figure 2:
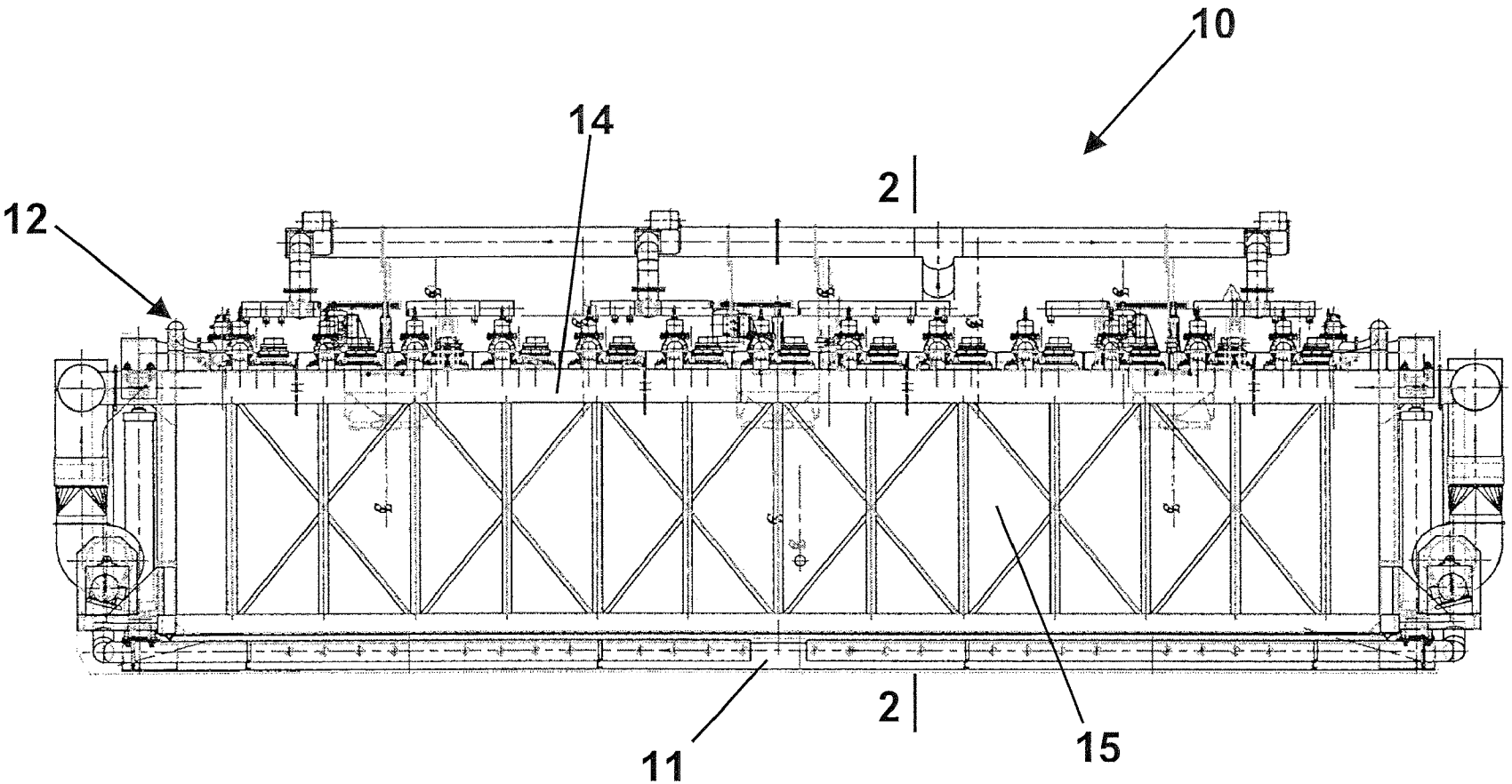
FIG. 2 is a front elevation view of the annealing furnace of the present invention.
Figure 3:
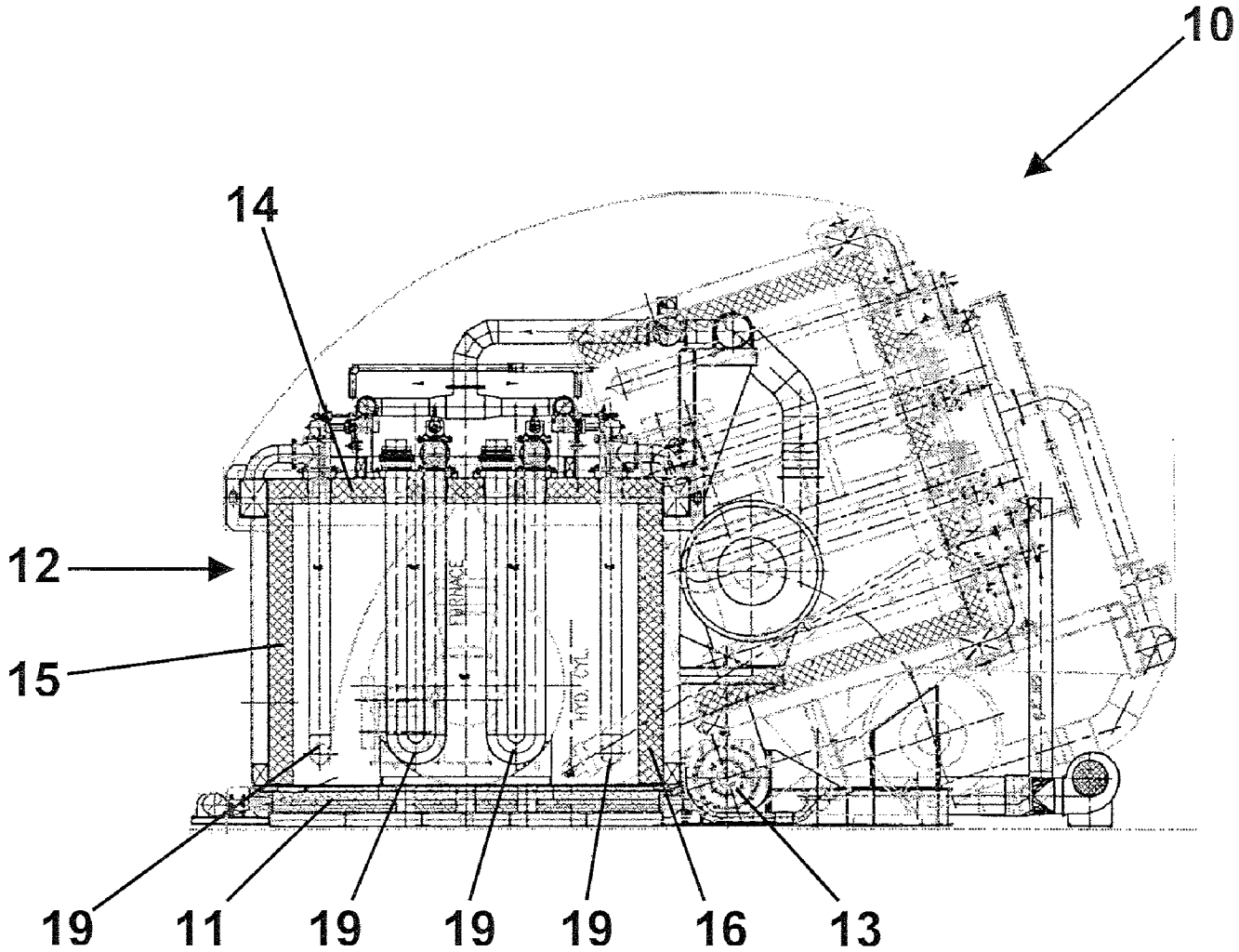
FIG. 3 is a cross-section view across of the annealing furnace of the present invention across lines 2—2 of FIG. 2.

The high temperature annealing furnace of the present disclosure is illustrated in FIGS. 1–3. Reference numeral 10 indicates a furnace for annealing hot rolled steel coils. Furnace 10 includes a base portion 11 and a furnace housing 12. The base portion 11 is the base on which the furnace 10 is positioned on the floor of the steel plant. Housing 12 includes a roof portion 14 and a plurality of side walls 15, 16, 17 and 18. Located within housing 12 are a plurality of heating elements 19 that are used to heat the hot rolled steel coils during the annealing process. Housing 12 pivotably rotates about a pivot member 13 between an opened and closed position, as seen in FIG. 3. Pivot member 13 has a lateral axis and is generally parallel with base portion 11.

Located within housing 12 and secured to base portion 11 is a retaining element (not shown) that configured to support at least one hot rolled steel coil, wherein each steel coil has an axial opening therethrough which is substantially horizontal to base portion 11 of the furnace. The retaining element is capable of holding a plurality of hot rolled steel coils separate from one another. Prior to the annealing process and when housing 12 is in the opened position, the retaining element is configured such that when each of the hot rolled steel coils is placed on the retaining element. Each steel coil may be capable of resting on the circumferential surface of the coil within the retaining element.

Heating elements 19 are located within the interior of housing 12 of furnace 10. In one embodiment, heating elements 19 are curved pipes positioned in a predetermined arrangement along the sides of side walls 15, 16, 17 and 18, as seen in FIG. 3, which are directly exposed to the hot rolled steel coils during the annealing process. In order to reach the desired annealing temperature for the hot rolled steel coils, compressed air, which may be heated by natural gas burners, is circulated through heating elements 19.

It will be understood that the annealing furnace of the present disclosure will be provided with a full compliment of controls, sensors, piping and the like. These elements are well known in the art and do not constitute a part of the present invention. The furnace cycle, including heating and cooling rates, atmosphere control, and the like, can be manually or computer controlled, or both. Various types of computer and manual controls are well known in the art and again do not constitute a part of the present disclosure.

This invention relates to all hot rolled steel coils wherein the steel includes any commercially available steel, such as, for example, high carbon steel, medium carbon steel, low carbon steel, and high temperature austenite grain coarsening steel such as those described in U.S. Pat. No. 7,048,033, which is hereby incorporated by reference.

Two grades of steel that can be annealed in the annealing furnace of the present disclosure include high carbon steel, having approximately 0.50 or more weight percent carbon in the total steel, and low carbon steel, having approximately less than 0.02 weight percent carbon in the total steel. The hot roll annealing of the high carbon steel in the furnace provides a softening of the material to permit more efficient downstream processing, for example cold reduction, of the steel coils. At an annealing temperature from about 1200° F. to about 1650° F., the cycle time of the annealing process is less than 75 hours. At an annealing temperature in the range from about 1200° F. to about 1650° F., the annealing process may have a cycle time in the range from about 40 hours to about 60 hours.

One type of high temperature annealing process is called "spherodize annealing". In this type of annealing process for high carbon steel, the controlled heating and cooling process produces spheroidal globular particles resulting in steel coils that have good machining characteristics. In this type of high temperature annealing, the use of a normal air atmosphere during the annealing promotes decarburization of the steel coil. The combination of high heat and a normal air atmosphere initially depletes a layer of carbon on the surface of the steel coil and decarburization results. Decarburization produces a steel product having both structural and mechanical inconsistencies throughout its surface.

In order to inhibit the effects of decarburization that takes place in a normal atmosphere during the high temperature annealing process, the annealing furnace includes a system capable of establishing a reducing atmosphere within the furnace when it is sealed. Included in furnace 10 is a sealing device (not shown) that is capable of sealing housing 12 when it is in the closed position. The sealing device promotes an efficient and effective annealing process by maintaining a desired annealing temperature and reducing atmosphere during the annealing process.

The reducing atmosphere includes at least one inert gas and at least one polyolefin gas. The at least one inert gas may include helium, neon, argon, xenon, and nitrogen. The reducing atmosphere can also include at least one other gas that facilitates the annealing process. The reducing atmosphere may include nitrogen as an inert gas, propylene as a polyolefin gas and hydrogen gas. In one embodiment, the reducing atmosphere used in the high temperature annealing process of high carbon steel includes nitrogen gas in an amount greater than about 90%, hydrogen gas in a range between about 5% to about 7% and propylene gas in an amount less than about 1%.

The hot roll annealing of low carbon steel coils is also an embodiment of the present disclosure. This type of steel includes a low carbon motor lam grade material that is used in motor lamination of electrical steels for motors of automotive vehicles. The hot roll annealing of the low carbon steel produces the growth of larger grains within the steel which ultimately yields improved magnetic properties. These improvements include lower core loss, which is a reduction in the loss of magnetic field as the magnetic fields are alternated, and higher permeability of the steel that allows more of the magnetic field to permeate it. Another benefit of the hot roll annealing of the low carbon steel is that it softens the steel to promote a more efficient cold rolling process.

Based on the foregoing disclosure, it should be apparent that the furnace used for annealing hot rolled steel coils of the present invention will achieve the objectives set forth above. It is therefore understood that any evident variations will fall within the scope of the claimed invention. Thus, alternate specific component elements can be selected without departing from the spirit of the invention disclosed and described therein.

What is claimed is:

1. A method of annealing hot rolled steel coil comprising the steps of:

(a) assembling a furnace housing comprising a plurality of side walls, a base portion and a roof portion, where the housing pivotably rotates about a pivot member between an opened and closed position, wherein the pivot member has a lateral axis, (b) positioning hot rolled coils of steel in the furnace with the axis of positioned coils generally horizontal to the base portion, (c) pivoting housing about the axis of the pivot member to close the furnace, (d) establishing a reducing atmosphere within the furnace, (e) annealing the hot rolled coils of steel in the furnace with the axis of positioned coils generally horizontal to the base portion, and (f) pivoting housing about the axis of the pivot member to open the furnace.

2. The method of claim 1 where positioned coils are placed on circumferential surfaces within a retaining element.

3. The method of claim 1 where the reducing atmosphere comprises at least one inert gas and at least one polyolefin gas.

4. The method of claim 3 where the at least one inert gas is nitrogen.

5. The method of claim 3 where the at least one polyolefin gas is propylene.

6. The method of claim 1 where the reducing atmosphere comprises nitrogen gas in an amount greater than about 90%, hydrogen gas in a range between about 5% to about 7%, and propylene gas in an amount less than about 1%.

7. The method of claim 1 where the annealing of the hot rolled steel coil provides a cycle time of less than 75 hours at a temperature range from about 1200° F. to about 1650° F.

8. A furnace for annealing hot rolled steel coil comprising:

(a) a furnace housing comprising a plurality of side walls, a base portion, a roof portion and a pivot member with an axis generally parallel with the base portion, where the housing pivotably rotates about the pivot member between an opened and a closed position;

(b) a retaining element within the furnace housing where the retaining element holds each coil such that the axis of each coil is generally horizontal to the base portion while the housing pivotably rotates about the pivot member, (c) a sealing device capable of sealing the furnace housing when in the closed position, (d) a system capable of establishing a reducing atmosphere within the furnace when sealed, and (e) a plurality of heating elements located within the furnace housing capable of heating hot rolled steel coil during the annealing process.

9. The furnace of claim 8 where the retaining element is configured such that each of the hot rolled steel coils is capable of resting on circumferential surfaces of the coils.

10. The furnace of claim 8 where the furnace is capable of providing annealing of the hot rolled steel coil in a cycle time of less than 75 hours at a temperature range between about 1200° F. and about 1650° F.

11. The furnace of claim 8 where the system capable of establishing a reducing atmosphere comprises at least one inert gas and at least one polyolefin gas.

12. The furnace of claim 8 where the system capable of establishing a reducing atmosphere comprises at least one inert gas, including nitrogen, and at least one polyolefin gas.

13. The furnace of claim 8 where the system capable of establishing a reducing atmosphere comprises at least one inert gas and at least one polyolefin gas, including propylene.

14. The furnace of claim 11 where the system is capable of further providing hydrogen gas in the reducing atmosphere.

15. The furnace of claim 8 where the system capable of establishing a reducing atmosphere comprises nitrogen gas in an amount greater than 90%, hydrogen gas ranging from about 5% to about 7%, and propylene gas in an amount less than 1%.

16. The furnace of claim 10 where the annealing process has a cycle time in a range from about 40 hours to about 60 hours at a temperature in the range from about 1,200° F. to about 1600° F.

17. The method of claim 1 where the annealing of the hot rolled steel coils is performed by a batch process.

* * * * *